US007094100B2

(12) United States Patent
Nakano

(10) Patent No.: US 7,094,100 B2
(45) Date of Patent: Aug. 22, 2006

(54) CONNECTOR AND METHOD OF MOUNTING IT

(75) Inventor: Hiroshi Nakano, Yokkaichi (JP)

(73) Assignee: Sumitomo Wiring Systems, Ltd, (JP)

( * ) Notice: Subject to any disclaimer, the term of this patent is extended or adjusted under 35 U.S.C. 154(b) by 0 days.

(21) Appl. No.: 11/328,893

(22) Filed: Jan. 10, 2006

(65) Prior Publication Data

US 2006/0121780 A1 Jun. 8, 2006

Related U.S. Application Data

(62) Division of application No. 11/100,741, filed on Apr. 7, 2005.

(30) Foreign Application Priority Data

Dec. 4, 2004 (JP) ..... 2004-116939

(51) Int. Cl.
*H01R 13/73* (2006.01)

(52) U.S. Cl. ..... 439/570; 439/566

(58) Field of Classification Search ..... 439/566, 439/570, 571, 572, 83, 876, 567
See application file for complete search history.

(56) References Cited

U.S. PATENT DOCUMENTS 5,120,256 A 6/1992 Walden
5,533,908 A 7/1996 Henry et al.
6,012,949 A * 1/2000 Lok ..... 439/570
6,086,416 A 7/2000 Choy
6,254,429 B1 * 7/2001 Morita ..... 439/570
6,638,106 B1 10/2003 Wu
6,699,069 B1 * 3/2004 Inoue ..... 439/570

FOREIGN PATENT DOCUMENTS

DE 102 43 407 A1 4/2004
JP 6-203896 7/1994

* cited by examiner

*Primary Examiner*—Hien Vu
(74) *Attorney, Agent, or Firm*—Gerald E. Hespos; Anthony J. Casella

(57) ABSTRACT

A connector for a PCB (60) has two fixing members (40). Each fixing member (40) has a main plate (41) configured for mounting to a connector housing (12) and a mounting plate (42) bent from the main plate (41). Each mounting plate (42) has solder entering holes (47) and slits (50) between the solder entering holes (47) at a projecting edge of the mounting plate (42). A force that acts to turn the mounting plates (42) from one end is divided at each slit (50), thereby preventing the mounting plates (42) and the housing (12) from being detached from the PCB (60).

15 Claims, 8 Drawing Sheets

CONNECTOR AND METHOD OF MOUNTING IT

This application is a divisional of application Ser. No. 11/100,741 filed on Apr. 7, 2005.

BACKGROUND OF THE INVENTION

1. Field of the Invention

The invention relates to a connector to be mounted to an electric or electronic device, such as a printed circuit board.

2. Description of the Related Art

Japanese Unexamined Patent Publication No. H06-203896 discloses a circuit board connector with a housing. Board fixing portions are formed integrally with the housing and bulge out sideways from the bottom ends of the opposite side surfaces of the housing. The board fixing portions are formed with screw holes. Screws can be inserted from the underside of a circuit board and fastened to the screw holes for fixing the housing to the circuit board. The connector, however, requires a large arrangement space on the circuit board because the board fixing portions bulge out sideways.

A miniature circuit board connector has been proposed with fixing members on side surfaces of a housing. The fixing members are secured to a circuit board by soldering. However, this construction is inferior to the screw fastening construction in strength against the peeling-off from the circuit board. Thus, a countermeasure has been of urgent necessity.

The present invention was developed in view of the above problem and an object is to allow the reliable mounting of a connector to an electric/electronic device such as a printed circuit board.

SUMMARY OF THE INVENTION

The invention relates to a connector to be mounted on an electric device, such as a printed circuit board. The connector includes a housing and at least one fixing member. The fixing member has a main plate that is mountable on a side surface of the housing. The fixing member also has a mounting plate that is bent to project from one edge of the main plate. The mounting plate includes a plurality of spaced-apart solder entering holes. Slits are formed at a side edge of the mounting plate at positions between the adjacent solder entering holes.

The mounting plate can be placed on the electric device. Solder attached to the printed circuit board then is caused to enter the solder entering holes and is solidified therein. Thus, the mounting plate and the housing are fixed on the electric/electronic device.

A force could act to turn the mounting plate from one side with respect to an arranging direction of the solder entering holes. This force could turn the mounting plate in a manner that could peel the soldered portion from the printed circuit board. However, the slits are between the solder entering holes. Thus, a force that acts to turn the mounting plate from the one-end is divided at each slit. Accordingly, the mounting plate is not turned to the end, and remains secured from an intermediate position on. Therefore, the mounting plate and the housing will not detach from the electric/electronic device.

The slits preferably extend up to or near a base end of the main plate continuous with the mounting plate. Thus, the peeling force is divided more securely where the slit is formed, thereby increasing a possibility of keeping the mounting plate secured from this position on.

At least one of the slits preferably extends from the mounting plate to a bottom portion of the main plate.

A base end of the main plate continuous with the mounting plate preferably is stepped to retract away from the side surface of the housing.

The circuit board connector may be installed in a high-temperature atmosphere. Thus, a differential thermal expansion between the housing and the printed circuit board generates a shear force to cause the mounting plate to slide on the printed circuit board while the housing pushes the main plate of the fixing member. Thus, there is a possibility that the soldered portion is peeled off to detach the mounting plate. However, the base end of the main plate is stepped. Thus, the pushing force is absorbed while the main plate is deformed resiliently at the base end to prevent the transmission of the pushing force to the mounting plate. As a result, the mounting plate is kept secured to the printed circuit board without producing a shear force between the mounting plate and the printed circuit board and the housing will not be detached from the printed circuit board.

The fixing member preferably is mountable to the housing so that the mounting plate can be positioned and/or retained substantially flush with or slightly below a side of the housing facing an electric device.

The fixing member preferably is mounted to the housing so that one or more biting projections on the fixing member bite in a portion of the housing.

A mounting operation of the fixing member preferably is stopped by the contact of one or more stepped or slanted portions of the main plate with respective abutment portions in the housing.

These and other objects, features and advantages of the invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
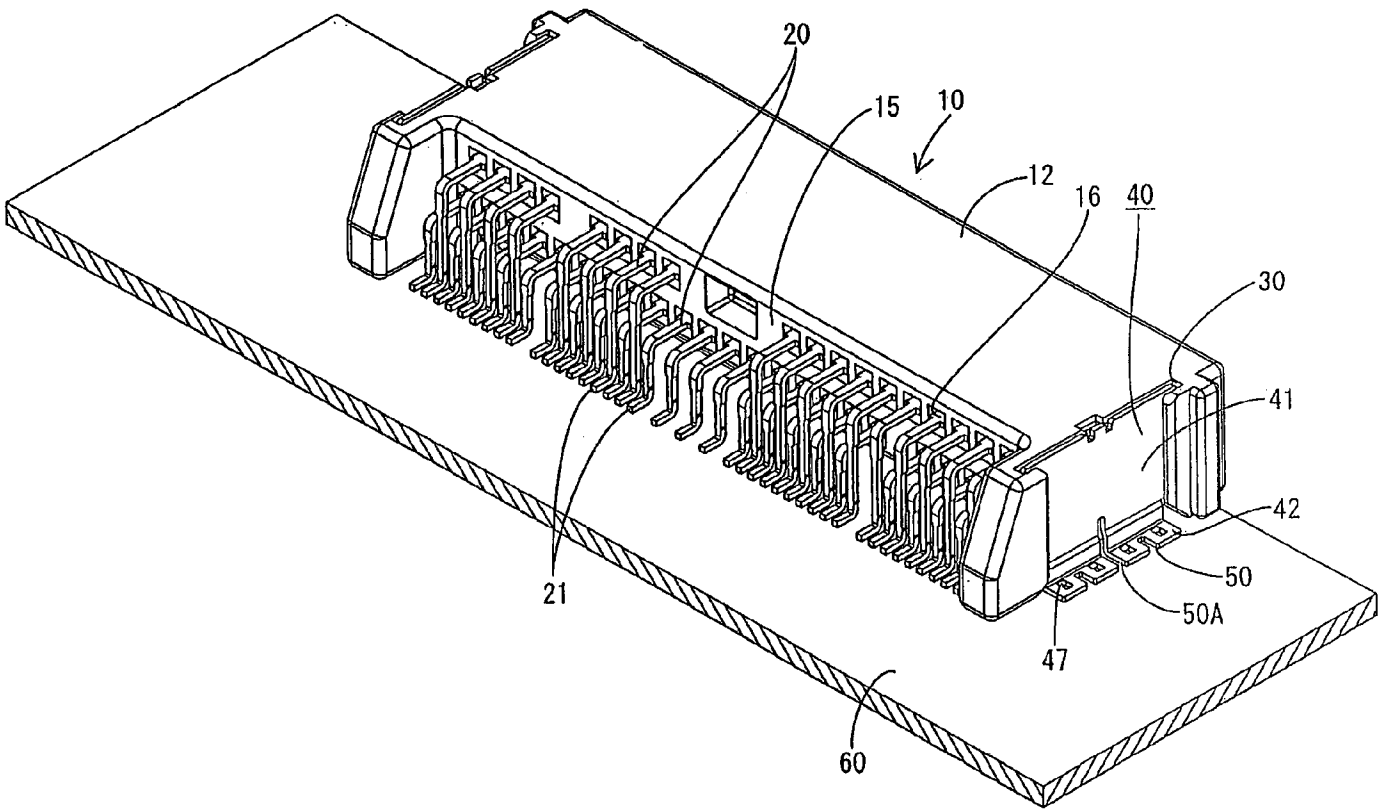
FIG. 1 is a perspective view showing a state where a circuit board connector according to one embodiment of the invention is fixed onto a PCB.
Figure 2:
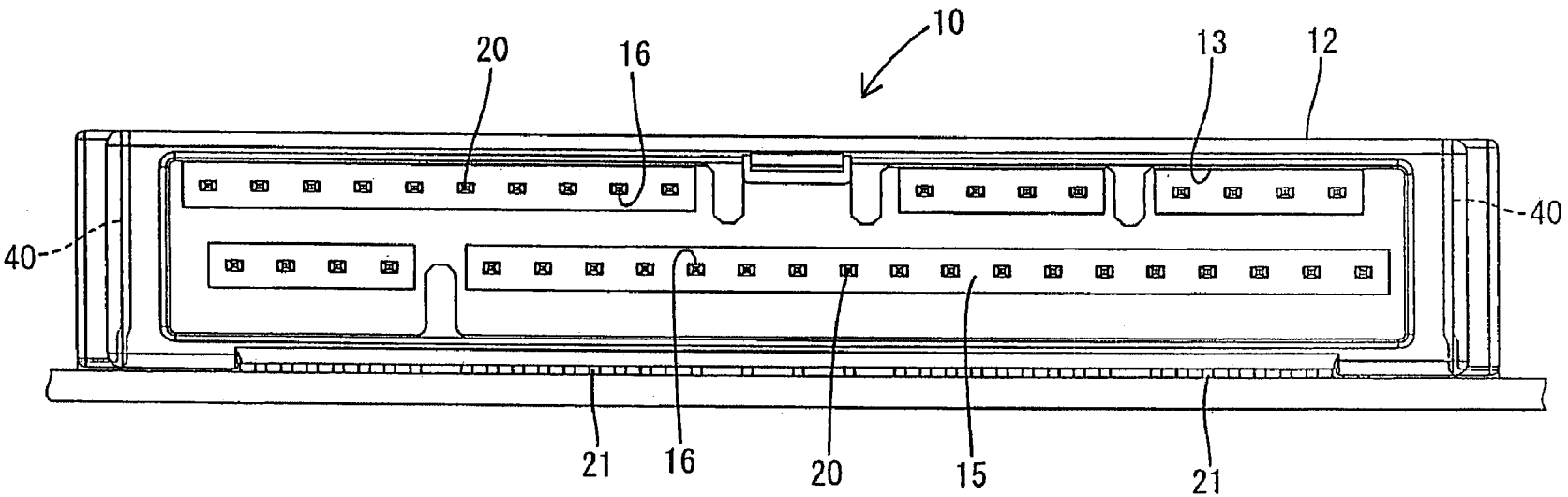
FIG. 2 is a front view of the circuit board connector.
Figure 3:
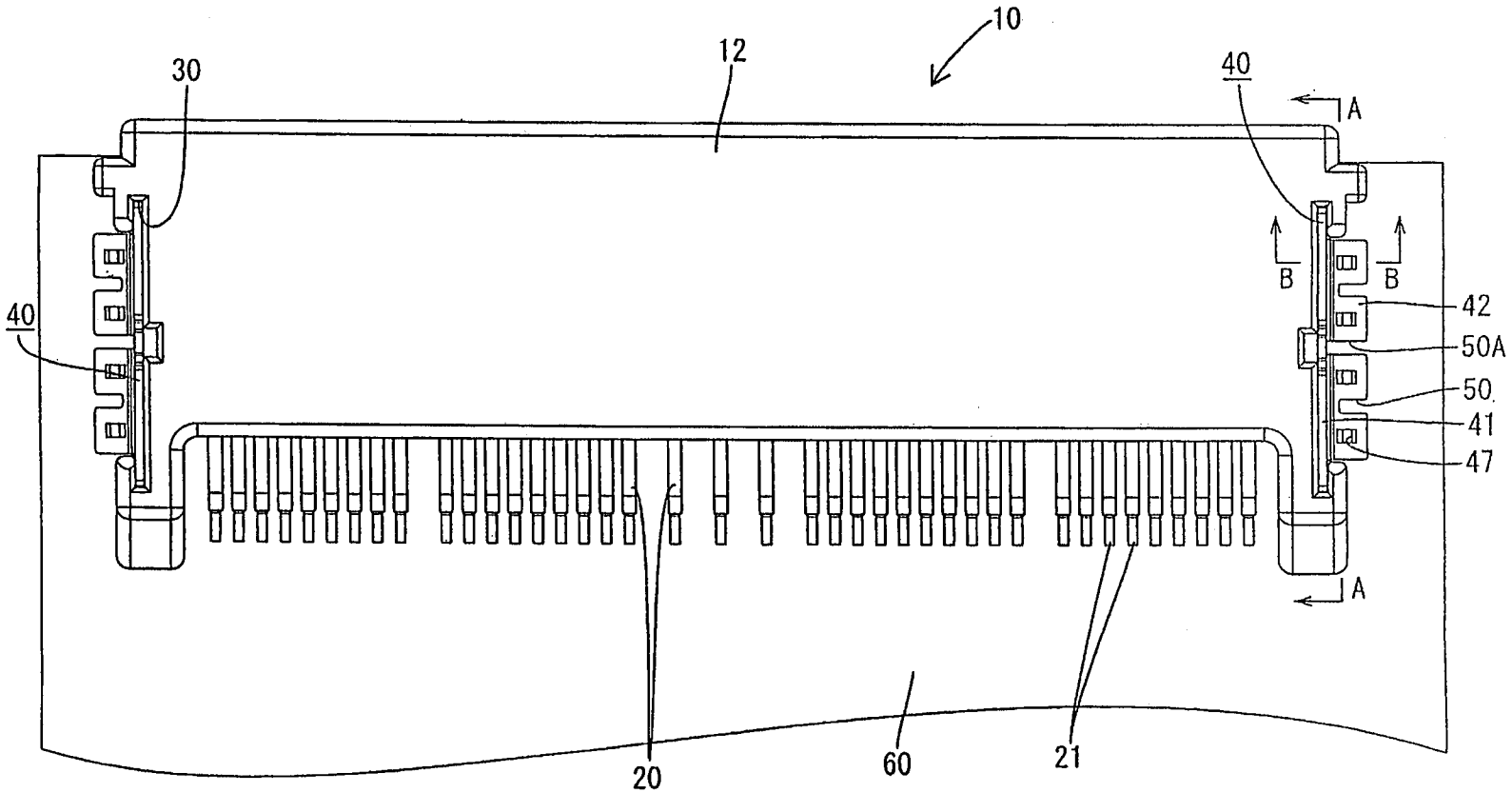
FIG. 3 is a plan view of the circuit board connector.

A circuit board connector according to the invention is identified by the numeral 10 FIGS. 1 to 3. The connector 10 can be fixed to a printed circuit board (PCB) 60 or to some other electric or electronic device, such as an electric junction box, an automotive dashboard, etc.

The connector 10 includes a wide block-shaped housing 12 made e.g. of a synthetic resin. A fitting recess 13 is formed in the front surface of the housing 12, as shown in FIGS. 2 and 3, for receiving a mating female connector housing (not shown). A base wall 15 is formed at the back of the fitting recess 13 and terminal insertion holes 16 are formed at upper and lower stages in the base wall 15. A terminal fitting 20 is inserted into each terminal insertion hole 16, and the inserted ends of the terminal fittings 20 project substantially in alignment in the fitting recess 13.

The terminal fittings 20 also project back from the base wall 15 and are bent down at right angles rearward of the base wall 15. The terminal fittings 20 then are bent again substantially at right angles at positions substantially aligned with the bottom surface of the housing 12. Thus, the rear ends of the terminal fittings 20 extend back substantially parallel to the PCB 60 to define connecting portions 21. As described later, the connecting portions 21 of the respective terminal fittings 20 are soldered, welded or otherwise connected to conductor paths on the PCB 60 for connection.

Figure 4:
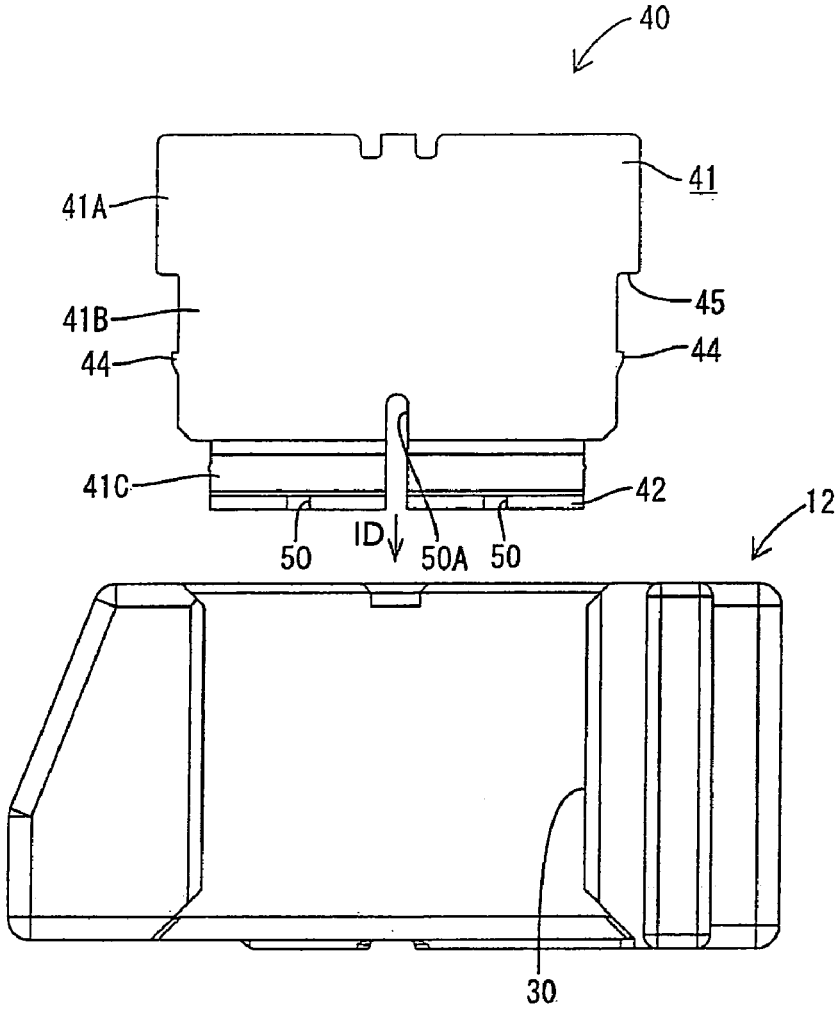
FIG. 4 is a side view showing the mounting of a fixing member.
Figure 5:
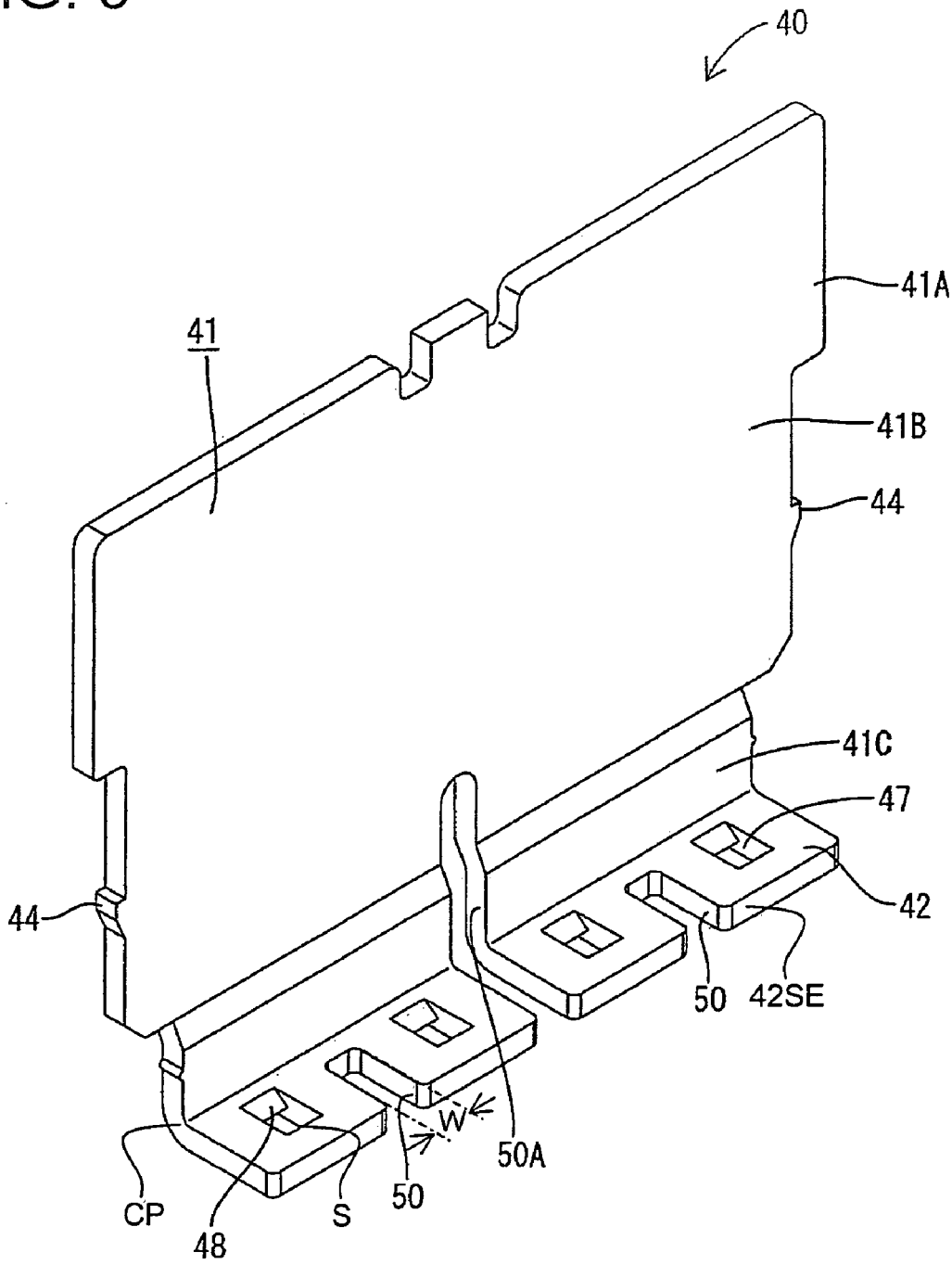
FIG. 5 is a perspective view of the fixing member.
Figure 6:
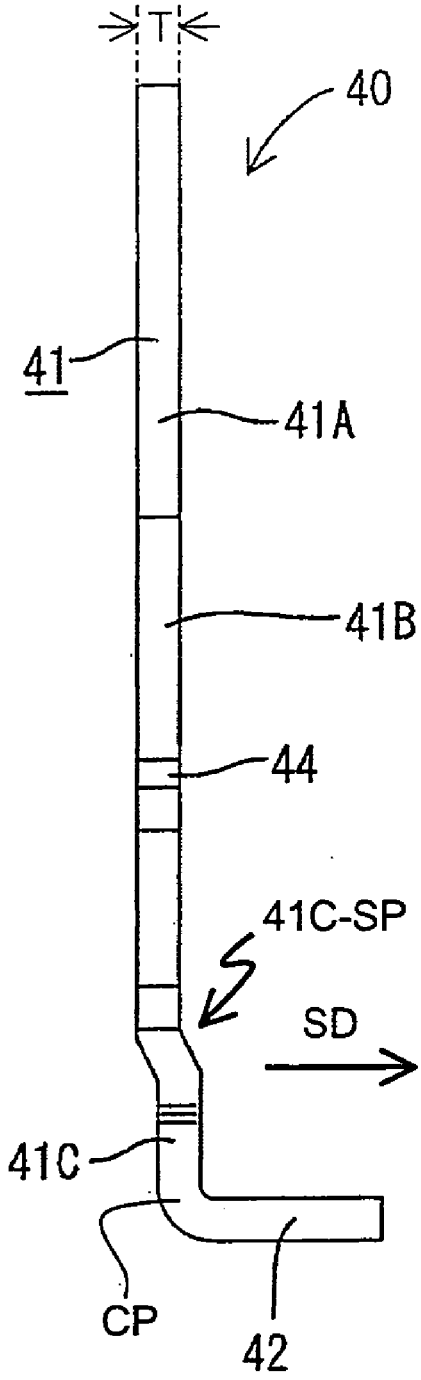
FIG. 6 is a side view of the fixing member.

Fixing members 40 are mounted on opposite side surfaces of the housing 12 for fixing the housing 12 on the PCB 60 by soldering. Each fixing member 40 is formed by press-working a unitary metal plate to define a main plate 41 and a mounting plate 42 that are bent at a right angle to define a substantially L-shape, as shown in FIGS. 4 to 6. The main plate 41 is mounted on the side surface of the housing 12 and the mounting plate 42 is placed on the PCB 60.

As shown in FIG. 4, the main plate 41 is stepped to have a top portion 41A, a middle portion 41B and a bottom portion 41C defining three widths that are narrowed from the top to the bottom. As shown in FIG. 6, the bottom portion 41C has a step 41C-SP offset in a direction SD substantially normal to a plane containing the main portion 41 by a distance that preferably is more than about one third the thickness T of the fixing member 40, and most preferably about half the thickness T. Biting projections 44 are formed on the opposite lateral edges of the middle portion 41B.

Figure 7:
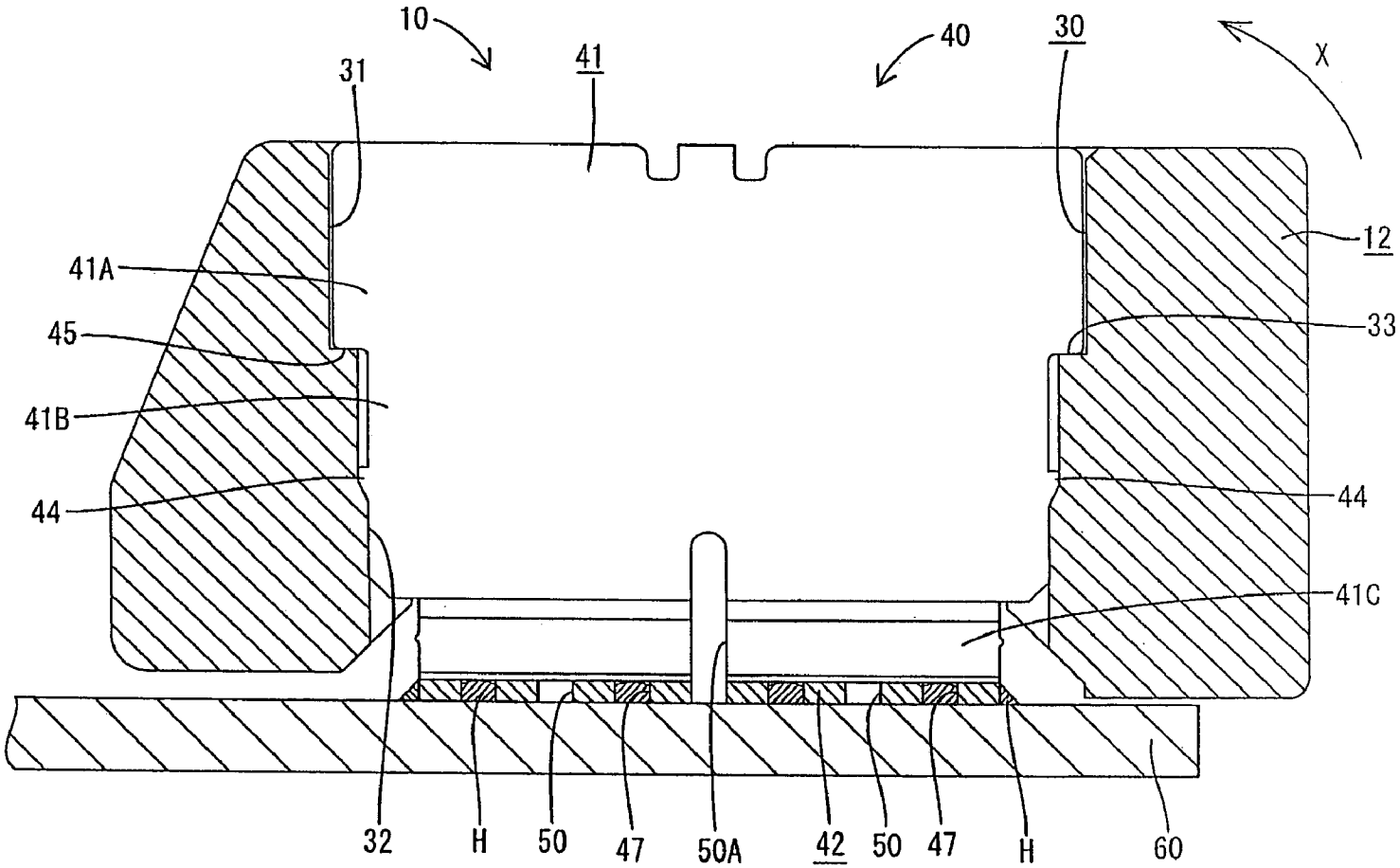
FIG. 7 is an enlarged section along 7—7 of FIG. 3.

Mount grooves 30 are formed in the opposite side surfaces of the housing 12, as shown in FIGS. 4 and 7, and are configured for receiving the main plate 41 of the fixing member 40 from above. The mount groove 30 has a wide portion 31 at an upper end distal from PCB 60 and a narrow portion 32 at a lower end adjacent to PCB 60. The wide and narrow portions 31 and 32 communicate with each other. The wide portion 31 has a width substantially equal to the width of the upper portion 41A of the main plate 41 and the narrow portion 32 has a width substantially equal to the width of the middle portion 41B of the main plate 41.

The main plate 41 of the fixing member 40 is inserted in the insertion direction ID into the mount groove 30 from above, as indicated by an arrow in FIG. 4. Thus, the biting projections 44 bite in the walls of the narrow portion 32, as shown in FIG. 7. The pushing operation is stopped when steps 45 between the upper and middle portions 41A and 41B of the main plate 41 abut steps 33 between the wide and narrow portions 31 and 32 of the mount groove 30. Thus, the fixing member 40 is mounted with the mounting plate 42 retained substantially flush with or slightly below the bottom surface of the housing 12.

The mounting plate 42 of each fixing member 40 is bent substantially at a right angle from the bottom end of the bottom portion 41C of the main plate 41. As shown in FIG. 3, the mounting plate 42 projects from the side surface of the housing 12 when the main plate 41 is inserted into the mount groove 30.

Figure 8:
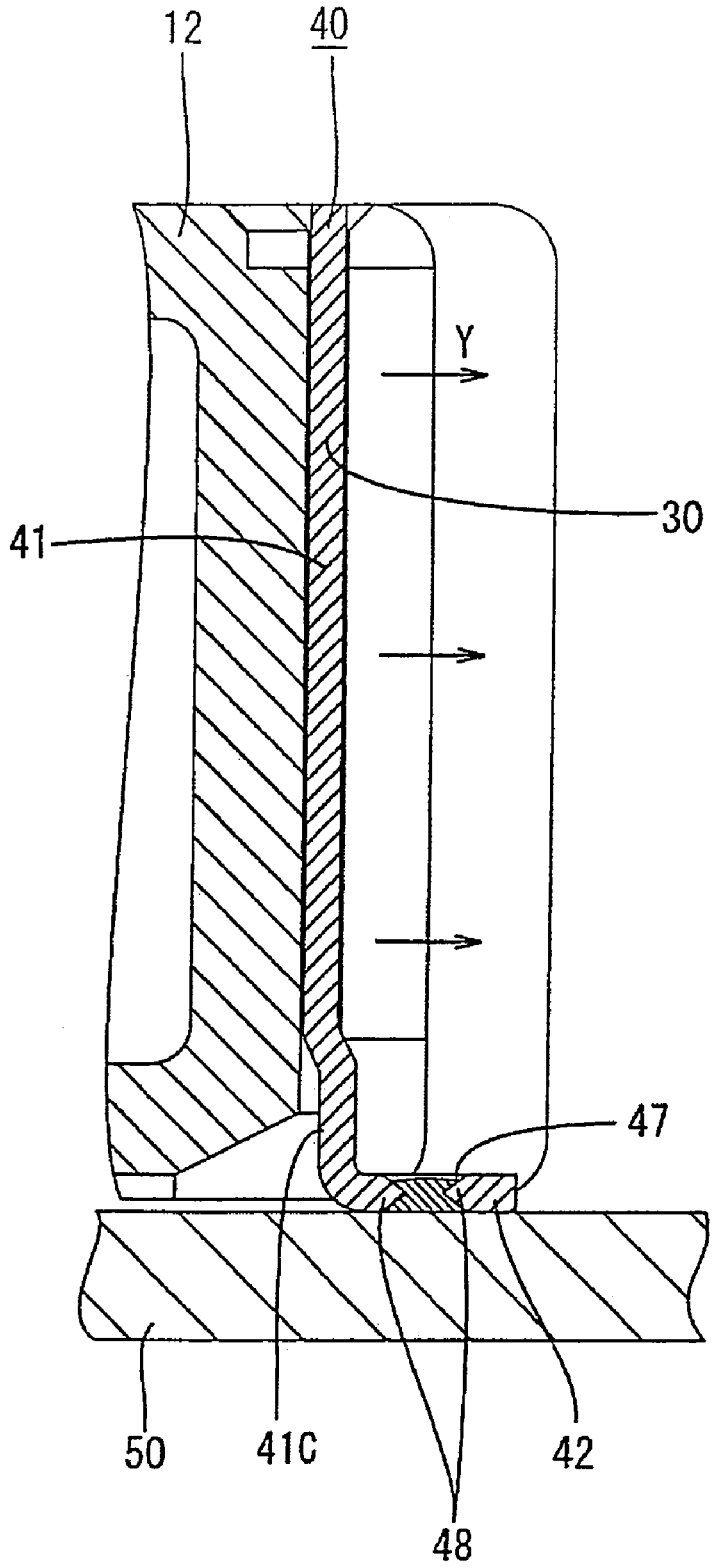
FIG. 8 is an enlarged section along 8—8 of FIG. 3.

The mount plate 42 has spaced apart solder entering holes 47. The solder entering holes 47 are substantially rectangular in plan view and penetrate the mount plate 42 vertically. Further, as shown in FIG. 8, angled locks 48 are formed on the left and right surfaces of the solder entering hole 47 and have a substantially triangular polygonal cross section.

The mounting plate 42 has slits 50 that extend normal to the longitudinal direction of the bend between the main and mounting plates 42 at positions between the solder entering holes 47. The slits 50 extend from a side edge 42SE of the mounting plate 42. The slits 50 have a width W slightly shorter than one side S of the solder entering holes 47 and extend from the projecting edge 42SE of the mounting plate 42 towards a coupling position CP of the mounting plate 42 to the bottom portion 41C of the main plate 41. The middle slit 50A extends the mounting plate 42 to a bottom part of the middle portion 41B by way of the bottom portion 41C of the main plate 41.

The terminal fittings 20 are mounted in the housing 12, and the fixing members 40 are mounted in the mount grooves 30 in the side surfaces, as described above.

On the other hand, solder H is applied at planned positions for soldering on the outer surface of the PCB 60. Thereafter, the circuit board connector 10 is placed on the surface of the PCB 60 so that the connecting portions 21 of the terminal fittings 20 register with the solder H, and so that the peripheral edge of the mounting plate 42 where no slit 50 is formed and the solder entering holes 47 register with the solder.

The PCB 60 with the circuit board connector 10 thereon is directed through a high-temperature oven (not shown) in this state. Thus, the solder H applied to the PCB 60 in advance is molten to attach to the connecting portions 21 of the terminal fittings 20. Further, the solder H is attached to the peripheral edges of the mounting plates 42 of the fixing members 40 and enters the solder entering holes 47 to attach to the inner surfaces thereof.

The solder H is cooled and solidified to connect the connecting portions 21 of the terminal fittings 20 electrically with the corresponding conductor paths. Further, the mounting plates 42 are secured to the PCB 60 at their peripheral edges and the solder entering holes 47. The angled locking sections 48 project into the solder H in the solder entering holes 47. Thus, a holding force is enhanced.

In this way, the PCB 60 having the circuit board connector 10 placed thereon is arranged at a specified position, and the mating female housing is fit into the fitting recess 13 of the housing 12.

A force could act on the housing 12, as indicated by the arrow X of FIG. 7, to swing the housing 12. Such a force could be generated, for example, if wires drawn from the mating female housing are pulled. The force urges the mounting plates 42 from one side with respect to an arranging direction of the solder entering holes 47. Thus, there is a possibility that the soldered portions of the mounting plates 42 will be are peeled off the PCB 60. However, the slits 50 are formed between the solder entering holes 47. Therefore, a force to turn the mounting plates 42 from the one end is divided at each slit 50, and the mounting plates 42 are prevented from being turned completely to the end. More, particularly, the peeling force is divided more securely from the slit 50A to the base end of the main plate 41. Thus, even if the mounting plate 42 is peeled off at the right side of FIG. 7, it is secured at the left side of FIG. 7. Accordingly, detachment of the mounting plates 42 and the housing 12 from the PCB 60 is prevented to a great extent.

The PCB 60 having the circuit board connector 10 placed thereon could be installed in a high-temperature atmosphere. In this situation, differential thermal expansion between the housing 12 and the PCB 60 creates a shear force that causes the mounting plates 42 to slide on the PCB 60 while the housing 12 pushes the main plates 41 of the fixing members 40, as indicated by arrows Y of FIG. 8. Thus, there is a possibility that the soldered portions will peeled off and detach the mounting plates 42. However, the bottom portions 41C of the main plates 41 are stepped at the portion 41C-SP to project in the direction SD substantially parallel to the direction Y of the shear-force. Thus, even if the housing 12 pushes the main plates 41 of the fixing members 40, the pushing force is absorbed while the main plates 41 are deformed resiliently at the bottom portions 41C to significantly reduce the transmission of the pushing force to the mounting plates 42. As a result, the mounting plates 42 are kept secured to the PCB 60 without producing a shear force between the mounting plates 42 and the PCB 60, thereby preventing the housing 12 from being detached from the PCB 60.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

Only short slits extending within the width of the mounting plates may be formed. Conversely, only a small number of long slits extending from the mounting plates toward the base end side of the main plates may be formed.

The fixing members illustrated in the foregoing embodiment have both slits in the mounting plates and a stepped bottom portion of the main plates. However, fixing members with only one of these constructions may be formed depending on the application, conditions and the like.

The solder entering holes 47 are described as through holes in the preferred embodiment, but they may recesses with bottom walls and suitable retaining surfaces.

Even though in the above preferred embodiment the locking sections 48 are described as being angled, they may have any other shape having a suitable locking function substantially such as polygonal, pointed, rounded, etc.

What is claimed is:

1. A fixing member for mounting in an electrical connector housing that is fixed to an electrical device, the fixing member comprising a main plate defining a housing mounting plane parallel with a side wall of the housing, a step extending unitarily from the main plate and bent angularly from the housing mounting plane defined by the main plate, a base end plate extending unitarily from the step and being offset from the housing mounting plane and a mounting plate joined unitarily to the base end plate and extending away from the base end plate, the mounting plate being aligned at substantially perpendicular to the housing mounting plane defined by the main plate.

2. The fixing member of claim 1, wherein the step is joined unitarily to the main plate along with a first bend line, the mounting plate being joined unitarily to the base end plate along a second bend line, the first and second bend lines being substantially parallel.

3. The fixing member of claim 2, wherein the base end late is substantially parallel to the main plate.

4. The fixing member of claim 3, wherein the main plate has a thickness measured perpendicular to the housing mounting plane, the offset of the base end plate from the main plate being less than the thickness of the main plate.

5. The fixing member of claim 4, wherein the offset of the base end plate from the main plate is approximately one half the thickness.

6. The fixing member of claim 2, wherein the main plate has a width measured parallel to the first bend line between the main plate and the step, and wherein the mounting plate defines a width measured parallel to the first bend line between the main plate and the step, the width of the mounting plate being less than the width of the main plate.

7. The fixing member of claim 1, wherein the fixing member is formed from a metal plate.

8. The fixing member of claim 1, further comprising a plurality of solder entering holes extending through the mounting plate at spaced apart locations thereon.

9. The fixing member of claim 8, further comprising a plurality of slits extending into portions of the mounting plate from an edge of the mounting plate opposite the base end plate, the slits being disposed between the solder entering holes.

10. The fixing member of claim 9, wherein one of said slits extends from a projecting edge of the mounting plate continuously across the step and onto portions of the main plate adjacent the step.

11. An electrical connector to be mounted on a printed circuit boards, the connector comprising:

a housing having a mounting surface for disposition in opposed facing relationship to the printed circuit board and opposite first and second side surfaces extending away from the mounting surface; and first and second fixing members, each said fixing member having a substantially planar main plate mounted to a respective one of the first and second side surfaces of the housing, a step extending unitarily from the main plate and bent angularly away the housing, a base end plate extending unitarily from the step and being offset from the main plate and spaced from the respective side surface of the housing, and a mounting plate joined unitarily to the base end plate along a bend line and extending away from the housing, the mounting plate defining a plane aligned substantially perpendicular to the planar main plate.

12. The connector of claim 11, wherein each of said fixing members is formed unitarily from a metal plate material having a thickness, the base end plate being offset from the substantially planar main plate by a distance less than the thickness.

13. The connector of claim 12, wherein the mounting plate of each said fixing member is formed with a plurality of solder entering regions formed thereon so that solder can be received in the solder entering regions and between the base end plate and the housing for securing the housing on the printed circuit board.

14. The connector of claim 13, wherein the solder entering regions comprise a plurality of solder entering holes formed at spaced apart locations along the mounting plate.

15. The connector of claim 14, wherein the solder entering regions further comprise a plurality of slits extending into an edge of the mounting plate opposite the base end plate.

* * * * *